US008516665B2

(12) United States Patent
Clarke et al.

(10) Patent No.: US 8,516,665 B2
(45) Date of Patent: Aug. 27, 2013

(54) FASTENER

(75) Inventors: Michael Clarke, Tonbridge (GB); Christopher Sutcliffe, Liverpool (GB); Andrew Southern, Liverpool (GB)

(73) Assignee: Zagonda Limited, Tonbridge, Kent (GB)

( * ) Notice: Subject to any disclaimer, the term of this patent is extended or adjusted under 35 U.S.C. 154(b) by 538 days.

(21) Appl. No.: 12/663,412

(22) PCT Filed: Jun. 9, 2008

(86) PCT No.: PCT/GB2008/001969

§ 371 (c)(1),
(2), (4) Date: Jun. 8, 2010

(87) PCT Pub. No.: WO2008/149120

PCT Pub. Date: Dec. 11, 2008

(65) Prior Publication Data

US 2010/0263173 A1 Oct. 21, 2010

(30) Foreign Application Priority Data

Jun. 7, 2007 (GB) ..... 0710953.1

(51) Int. Cl.
*A44B 99/00* (2010.01)

(52) U.S. Cl.
USPC ..... 24/303; 24/590.1

(58) Field of Classification Search
None
See application file for complete search history.

(56) References Cited

U.S. PATENT DOCUMENTS 6,640,398 B2 * 11/2003 Hoffman ..... 24/303
2003/0154576 A1 8/2003 Mirharooni

FOREIGN PATENT DOCUMENTS

| | | | |
|---|---|---|---|
| EP | 0269539 | A2 | 6/1988 |
| EP | 1031294 | A1 | 8/2000 |
| GB | 2243645 | A | 11/1991 |
| GB | 2428912 | A | 2/2007 |
| JP | 9158934 | A | 6/1997 |
| WO | 2004066766 | A1 | 8/2004 |

OTHER PUBLICATIONS

Search Report for British Patent Application No. 0710953.1 dated Oct. 2, 2007.

* cited by examiner

*Primary Examiner* — Jack W. Lavinder
(74) *Attorney, Agent, or Firm* — Harness, Dickey & Pierce, P.L.C.

(57) ABSTRACT

A fastener comprising two parts (502,514) separable along a separation axis, at least one part (502) comprising a magnet (510) establishing magnetic force along the separation axis; and a mechanical coupling having complementary elements (508,522) formed respectively on the two parts (502,514) of the fastener, the mechanical coupling being configured such that movement together of the two parts (502,514) under magnetic force causes automatic relative rotation of the parts (502,514) about the axis.

5 Claims, 6 Drawing Sheets

FASTENER

CROSS-REFERENCE TO RELATED APPLICATIONS

This application is a 371 U.S. National Stage of International Application No. PCT/GB2008/001969, filed Jun. 9, 2008. This application claims the benefit of United Kingdom Patent Application No. GB 0720953.1, filed Jun. 7, 2008. The disclosures of the above applications are entirely incorporated herein by reference.

This invention relates to fasteners and in an important example to fasteners making use of magnetic forces.

It is common to use forces of magnetic attraction to provide a fastener device. The obvious advantage is ease of closure. Often, no mechanical work is required to be done to close the fastener, other than to bring two working parts together.

It is for example commonplace to use magnetic fasteners for door and similar fasteners. Simple, permanent magnet fasteners are well known. Electromagnets provide the opportunity for locking and unlocking of the fastener by switching on or off an energising current. With magnetic fasteners, there is a trade off between ease of operation and the strength of the fastener. Increasing the attractive force of permanent magnet devices—to increase the strength and security of the fastener and prevent unintended opening—simply increases the force required when it is intended to open the fastener. With electromagnetic devices, the strength of the fastener is restricted by design limitations on the strength of the magnetic attraction that can be created, including the space available and the cost of operation.

There are many other applications for magnetic fasteners. In US2003/0154576, for example, it is suggested to provide a cuff link in the form of two pieces held together by magnetic force. Similarly here, the strength of the magnetic attraction is limited by the obvious need for the force to be less than that readily applied by the user on deliberate unfastening. Such a simple arrangement is therefore unsuitable where a risk of unintended opening is unacceptable. A structure intended to overcome this problem is shown in GB 2 243 645. This combines a bayonet type fixing (common in itself) with magnetic attraction. The described structure is expected to be more resistant to accidental unfastening than a simple magnetic attraction device, although more cumbersome to fasten. Similarly, the structure is intended to be more resistant to accidental unfastening than a simple bayonet type fixing, although requiring more force to unfasten.

There remains in many applications a requirement for fasteners which can be fastened and unfastened relatively easily—without requiring any special dexterity or finger strength—but which have high fastening strength and a very low risk of accidental unfastening.

It is an object of certain aspects of the present invention to provide an improved magnetic fastener meeting such a requirement.

According to one aspect of the invention there is provided a fastener comprising two parts separable along a separation axis, at least one part comprising a magnet establishing magnetic force along the separation axis; and a mechanical coupling having complementary elements formed respectively on the two parts of the fastener, the mechanical coupling being configured such that movement together of the two parts under magnetic force causes automatic relative rotation of the parts about the axis.

The magnetic force may be attractive and the mechanical coupling being such that manual relative rotation of the parts provides a mechanical advantage to overcome the magnetic attraction on separation of the parts. At least one of the complementary elements of the mechanical coupling may be of helical formation about the separation axis.

According to one aspect of the invention there is provided a fastener comprising two parts separable along a separation axis, at least one part comprising an electro magnet establishing magnetic force along the separation axis; and a mechanical coupling having complementary elements formed respectively on the two parts of the fastener, the mechanical coupling being configured such that movement together of the two parts under magnetic force in one sense causes relative rotation of the parts to an intermediate configuration, movement of the two parts under magnetic force in the opposite sense serving to bring the parts from the intermediate configuration to a locked configuration in which separation of the parts is resisted by the mechanical coupling.

The mechanical coupling may comprises on one part a screw formation having two contiguous portions of opposite screw sense. Thus, right and left handed portions can be provided in a single thread path. The pitch and sense of the thread may more generally vary. A thread portion may be provided—usually at the end of the thread path—with a locking feature.

Repulsion as well as attraction may be employed with magnets that are permanent or electromagnetic or a combination. Electromagnets admit of easy control and switched actuation.

The invention will now be described by way of example with reference to the accompanying drawings, in which.

Figure 1:
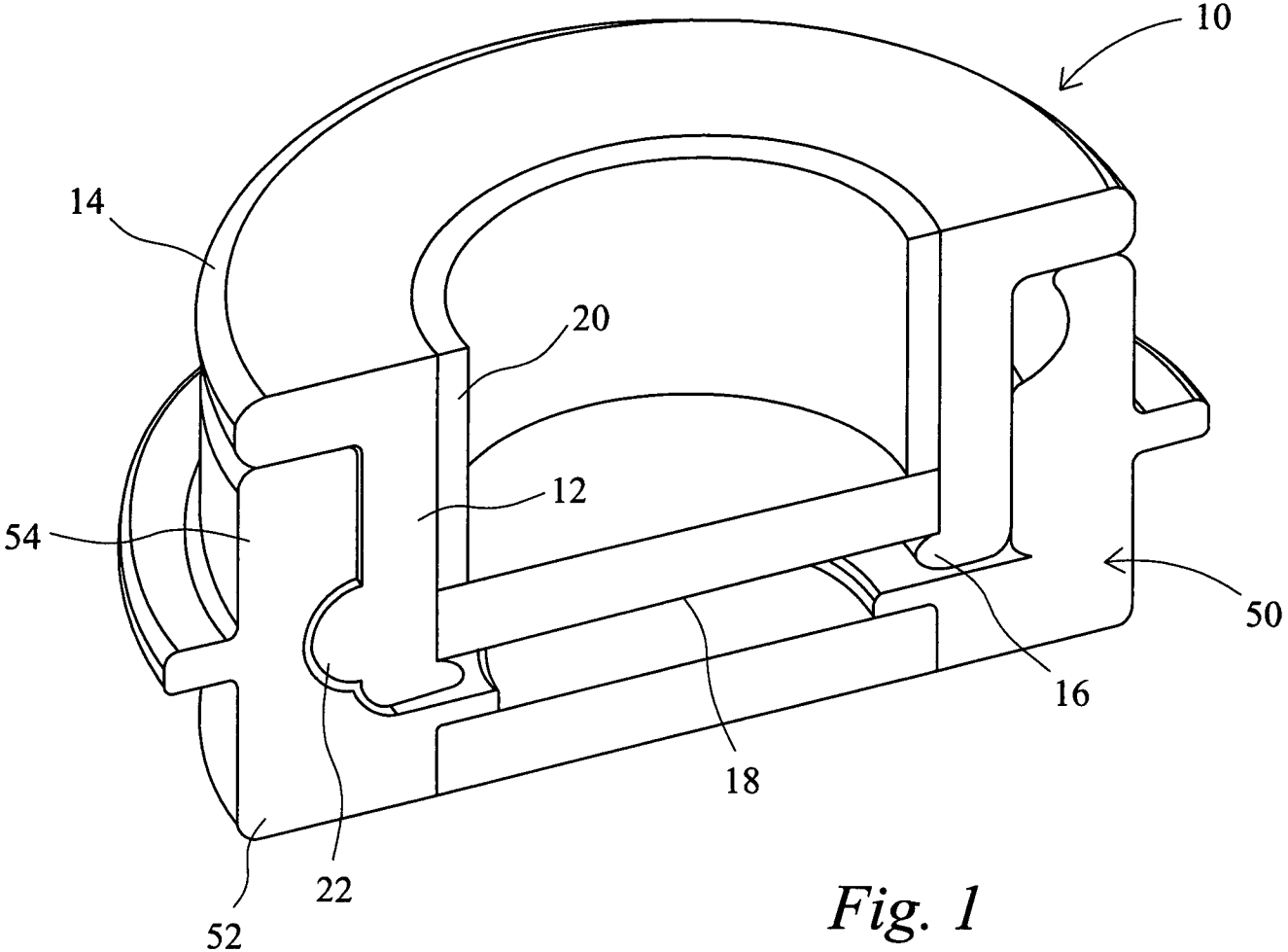
FIG. 1 is a sectional view through a two part fastener.
Figure 2:
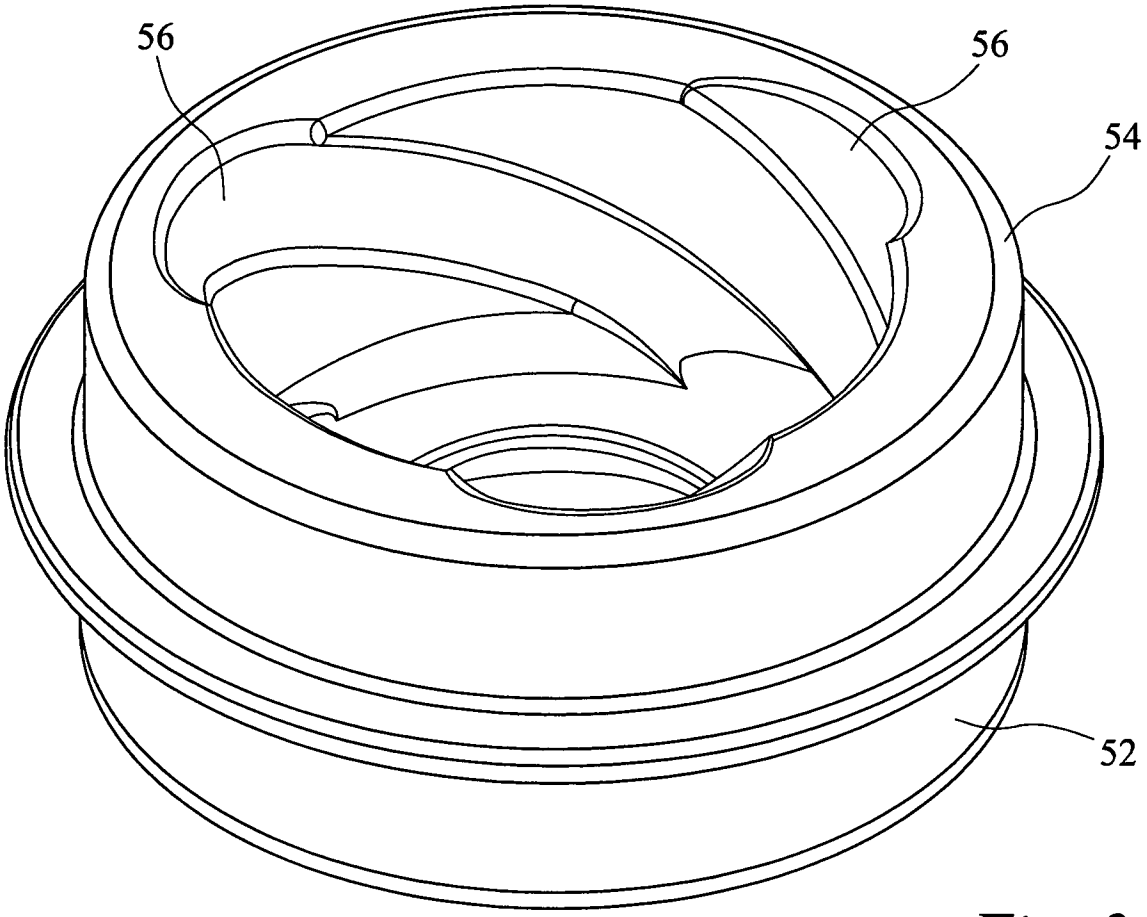
FIG. 2 is a perspective view of the female part of the fastener shown in FIG. 1.

A general purpose fastener will first be described with reference to FIGS. 1 and 2.

The fastener has a male part 10 and a female part 50. It will be seen that the male part 10 comprises a hollow cylindrical core 12 with an annular flange 14. At the end opposite the flange, the core 12 carries an inwardly directed lip 16. This lip serves to locate a disc shaped permanent magnet 18. A coaxial bush 20 within the hollow core completes the mounting of the magnet 18. The outer circumferential surface of the core 12 carries three helical or thread-like formations 22.

The female part 50 of the fastener (as seen also in FIG. 2) has an annular circular base 52 formed with an upstanding an annular rim 54. Three helical grooves 56 are cut into the circumferentially inner surface of the rim 54, the grooves 56 being dimensioned and positioned to engage as a screw thread with the formations 22. A disc shaped permanent magnet 58 is embedded in the base 52. A mounting ring 60 is formed on the periphery of the rim 54.

The cufflink is assembled by aligning the male part 10 and the female part 50 coaxially. The permanent magnets are chosen to be of high strength and are preferably Neodymium magnets with a typical formulation $Nd_2Fe_{14}B$. The strength of the magnetic attraction is such, having regard to the angle of the screw thread and the level of frictional forces, that the two parts are drawn into interlocking engagement with "automatic" relative rotation of the male part 10 and the female part 50 about the common axis of the circular magnet. This automatic fastening feature (in the sense that the user is required to apply no or substantially no torque about the axis to cause this rotation) means that fastening of the described device is no less difficult than fastening a simple magnetic fastener. However, the considerable advantage is provided that—because of the mechanical advantage available through the screw thread—a very much stronger magnet can be employed. Thus, it is possible to use a force of magnetic attraction that is too large to be overcome by the straight line force that a user can be expected to be able to apply. That same user can however readily apply sufficient torque about the axis to separate the parts against the attractive force of the magnets.

Figure 3:
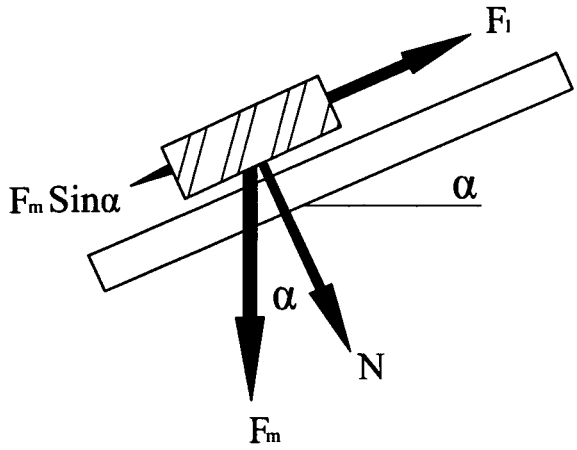
FIGS. 3 and 4 are force diagrams.
Figure 4:
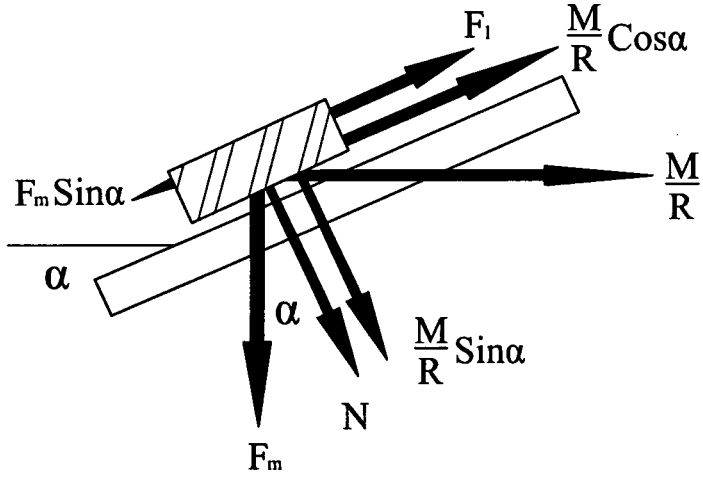

The design of the helical grooves or guides will now be described in more detail, with reference to FIGS. 3 and 4 which are force diagrams.

Each guide 56 has a helical form, with a constant progression axially per cycle (or part cycle, or per degree). This can be considered as a constant angle of progression, $\alpha$.

If the fastener is to be closed by the force of magnetic attraction, at any one moment the force (referring to FIG. 3) is considered as:

$$F_m = k_m r^{-2}$$

Where r is separation of the two magnets, $k_m$ is a function of the constants, $\mu$, $Q_{m1}$, $Q_{m2}$, $\pi$ & 4, all present in the Magnetism equations.

At the largest separation, $r_{max}$, the following equation must be satisfied to allow the device to fasten under the force of the magnet alone. This must be allowed at the outer most part of the channel ("top face").

$$N = F_m \text{ Cos } \alpha \ \& \ F_r = \mu_f N$$

(frictional forces)

$$F_r = \mu_f F_m \text{ Cos } \alpha$$

This gives the tipping point of: $\mu_f F_m \text{ Cos } \alpha = F_m \text{ Sin } \alpha$ (from free body diagram)

For static position.=>$\mu_f = \tan \alpha$

If: $\mu_f F_m \text{ Cos } \alpha < F_m \text{ Sin } \alpha$, then there will be a moment on the male part, which will lead to an angular acceleration closing the fastener. This gives the result that if the angle of the guide (at the radius it is acting) conforms to the value of:

$$\tan^{-1}(\mu_f) = \alpha$$

then the magnetic forces will be able to close the fastener and the male and female parts will automatically rotate, one relative to the other.

Since $F_m$ (the magnetic force) cancels out on both sides, as does the acting radius, this can be ignored from the analysis.

The same principles can be applied to the device when decoupling. This has the additional moment of the operator force. Some forces directions are reversed to allow for the reversing of the direction through the guide.

$$M/R \text{ Cos } \alpha = F_m \text{ Sin } \alpha + \mu_f (F_m \text{ Cos } \alpha + M/R \text{ Sin } \alpha)$$

$$M/R = F_m \text{ Tan } \alpha + \mu_f (F_m + M/R \text{ Tan } \alpha)$$

$$M/R = F_m \text{ Tan } \alpha + \mu_f F_m + \mu_f M/R \text{ Tan } \alpha$$

$$M/R - \mu_f F_m = \text{Tan } \alpha (\mu_4 M/R + F_m)$$

$$a = \text{Tan}^{-1}[(\mu_f/R + F_m)/(M/R - \mu_f F_m)]$$

This is not as simple as the coupling equations because it involves more than one variable for the forces involved. We can define a ratio of Magnetic force (largest at fully engaged) to Moment divided by acting radius.

$$M/R = F_m (\text{Sin } \alpha + \mu_f \text{ Cos } \alpha)/(\text{Cos } \alpha - \mu_f \text{ Sin } \alpha)$$

This is the expression for the moment required to keep the fastener turning. To start the fastener initially moving, a slightly larger force is required. Once in motion, the separation increases, which causes the magnetic forces to decrease in proportion to the inverse square of the separation. We can then say that if a constant moment is kept on the plug, the device will accelerate as the ratio of the forces changes.

Figure 5:
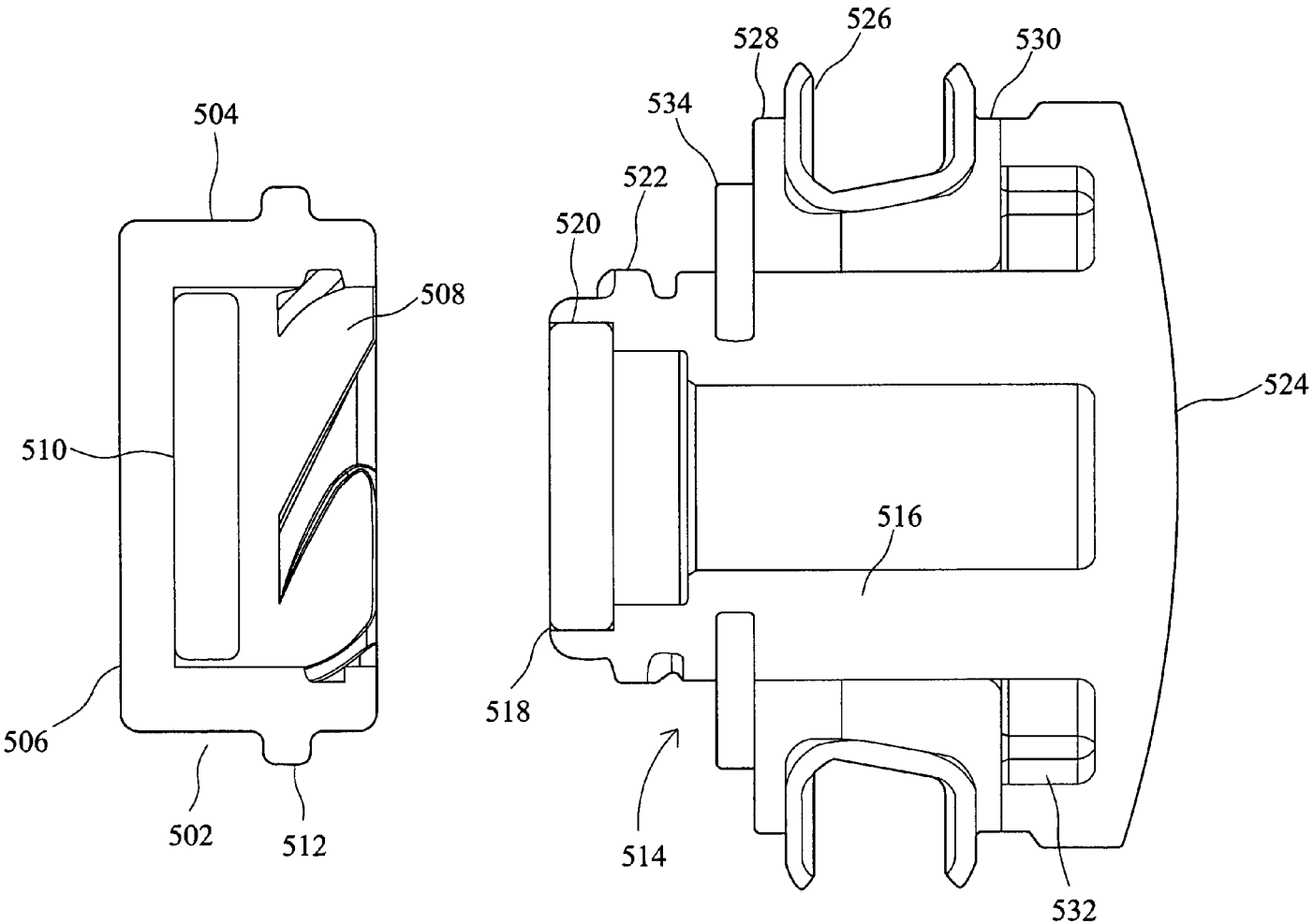
FIG. 5 is a sectional view of a different form of two part fastener.

A different example of a fastener will now be described with reference to FIG. 5. This fastener may be used for example with articles of clothing, personal accessories and a variety of containers. A female part 502 is generally cup shaped having an annular rim 504 formed integrally with a base 506. The interior of the rim is formed with helical guide grooves 508. A disc shaped permanent magnet 510 is bonded to the interior surface of the base 506. Radial projections 512 on the exterior of the rim 504 may assist in mounting of the part 502.

The male part 514 of the fastener comprises a cylindrical core 516, which may be hollowed to reduce weight. At one end of this core 516 is mounted a disc shaped permanent magnet 518, poled so as to attract magnet 510. Conveniently, the magnet 518 is seated in a recess 520 in the core 516. Around this end of the core is formed a helical thread formation 522, shaped to engage with the helical guide grooves 508.

At the opposite end of the core 520 is provided a disc 524, preferably formed integrally. In the mid-region, the core carries a U-shaped ring 526 serving as an eye rivet enabling the part 514 to be mounted through a circular aperture in a flap, lid or other flat work piece. The ring 526 is mounted to permit relative rotation of the core 520. To this end, a bearing is formed with split bearing rings 528, 530; end ring 532 which is recessed into the disc 524 and retaining ring 534. Appropriate parts of the bearing, such as the bearing rings 528,530, are usefully formed of PTFE or other low friction material.

In use, the free end of the male part 514 is brought manually into register with the opening of the female part. With the same design principles explained above, the force of magnetic attraction is chosen so that the fastener self closes, with the core 516 rotating "automatically" as the two parts of the fastener are magnetically drawn together. Unfastening is achieved by manual rotation of the core by the using holding the disc 524 in the fingers. For this purpose, the disc 524 may have a non-circular shape or may have other surface or shape features to improve grip by the fingers.

This example of fastener has the advantage explained previously that a very strong magnet may be employed, giving improved security. The risk of accidental unfastening will be seen to be very low. Nonetheless, the fastener can be unfastened when require, by simple rotation. The mechanical advantage afforded by the thread formation is such that relatively low torque can overcome relatively strong magnetic attraction. Another advantageous feature is that the rotation of the disc 524, which occurs automatically as the fastener closes, may be visually attractive. The exterior of the disc may be designed to enhance this affect. In some examples, formations may be provided which give an audible indication of the relative rotation.

Figure 6:
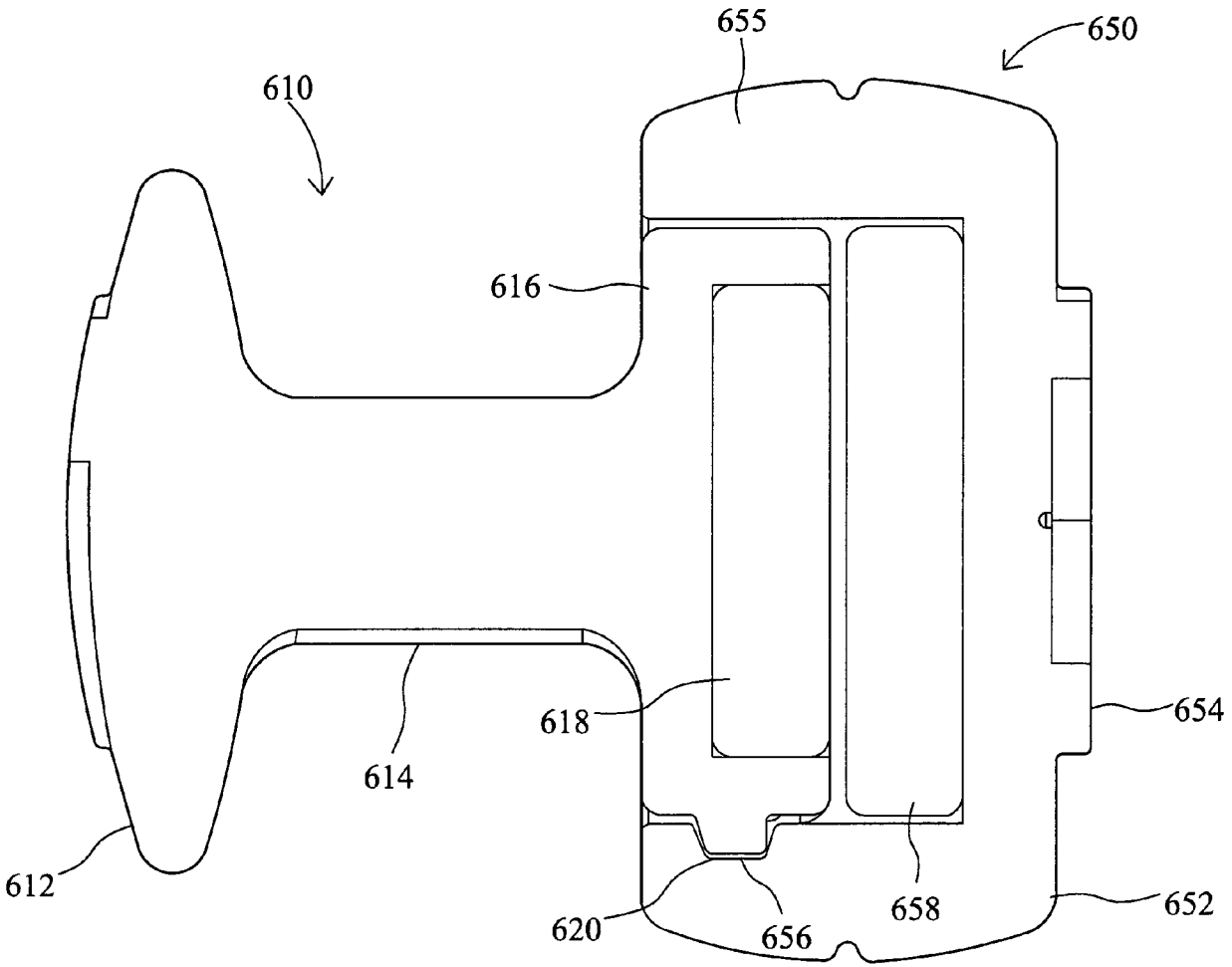
FIG. 6 is a sectional view through a cuff link.

A further variation of the fastener will be described taking the example of a cufflink. Reference will be directed to FIG. 6.

Ordinarily, cufflinks—which may have a high value—are formed in a single part. To enable the cufflink to pass through button holes, the cufflink is often provided with a hinge or with a flexible link element. In this embodiment of the present invention, a single cufflink is formed from two separable parts, considerably simplifying the application of the cufflink to button holes.

The cufflink has a male part 610 and a female part 50. It will be seen that the part 610 comprises a plate 612 which may carry a decorative motif applied to its outer face. The inner face of the plate 612 is bonded to or formed integrally with a pillar 614 which carries a base 616. Located within the base 616 is a disc shaped permanent magnet 618. The circumferential surface of base 616 carries three helical or thread-like formations 620.

The female part 650 of the cufflink is generally cup-shaped and is dimensioned to fit over the base 616. Part 650 has a circular base 652, the outer face of which may carry a design feature 654. The part 650 further comprises an annular rim 655. Three helical grooves 656 are cut into the circumferentially inner surface of the rim 655, the grooves 656 being dimensioned and positioned to engage as a screw thread with the formations 620. A disc shaped permanent magnet 658 is embedded in the part 650.

As described previously, it is possible to use a force of magnet attraction that is too large to be overcome by the straight line force that a user can be expected to be able to apply. That same user can however readily apply sufficient torque about the axis to separate the parts can be against the attractive force of the magnets. Of course, gripping of the two parts can be facilitated in ways such as choosing non-circular shapes or appending grips.

Whilst two specific applications have been illustrated, the standard device can be used to secure a very wide variety of components rapidly in a repeatable manner which is resistant to axial load. For example the device could be used to secure the limbs of a mannequin. The arm say would be easily magnetically attached by having the socket end of the device on the arm and the plug end on the torso. This would allow rapid disconnection for dressing the mannequin.

This technique could also be applied to the attachment of prosthetic devices such as facial prosthetics for the nose ear and eyes. Currently these are magnetically attached with a plurality of magnets each attached to osteo-integrating screws implanted into the patient's bone. The prosthetic device is attached to the plurality of magnets and is held firmly in place by the respective location of the magnets. This, whilst a convenient way to attach the devices, may cause several problems. The prosthetic is prone to become detached from the patient, alignment is difficult and many bone screws are used. Use of a locking device as described here would offer many benefits, including very firm axial and radial location of the device, natural resistance to being knocked off, reduction of the number of screws required to attach the device for a minimum of three to one.

Similar medical attachment devices could be envisaged for instance the attachment of lower limb prosthetics false legs and the like.

In these and other examples of fasteners according to the invention, many modifications can be made to the design without departing from the scope of the invention. Thus, different numbers and different types of helical formations could be employed. It is not necessary for both elements of a screw formation to be helical; a single or multiple pins on part could engage with a helical groove or projection on the other part to effect relative rotation. The pitch of a screw formation may vary along the axis of magnetic attraction. A screw thread may have an additional locating feature providing an end or other stop. Whilst two permanent magnets will provide greater force, some application may be best served with a magnet on one part and suitable magnetic material in the other.

This invention also has application with electromagnets.

An electromagnetically operated fastener will now be described, taking the example of a door lock, such as those actuated by a swipe card.

Currently swipe card entry door locks rely on large electromagnets for their operation. It is generally possible to overcome the magnetic force in these door locks reasonably easily and hence they do not provide for high security. Increasing the force requires large magnets and higher currents, which may not always be practical or economic.

Figure 7:
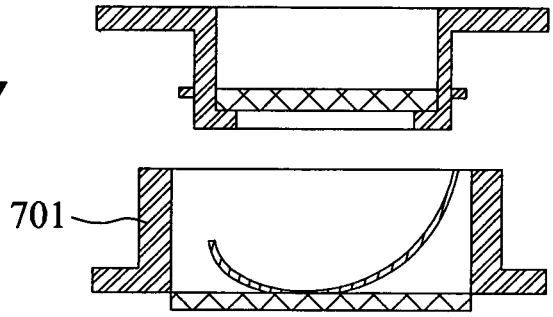
FIG. 7 is a diagram illustrating an electromagnetically actuated fastener

Referring now to FIG. 7, a door fastener is shown schematically. A fixed part 701 carries an electromagnet 702. The part 701 carries an internal thread formation comprising a first part 703 which is right-handed and a second portion 704 which is left handed. The door mounted part 705 carries pins 706 which engage in the thread formation and also carries a permanent magnet 707. One part or other of the fastener (as convenient) is mounted or configured to provide for relative rotation about the axis.

Figure 8:
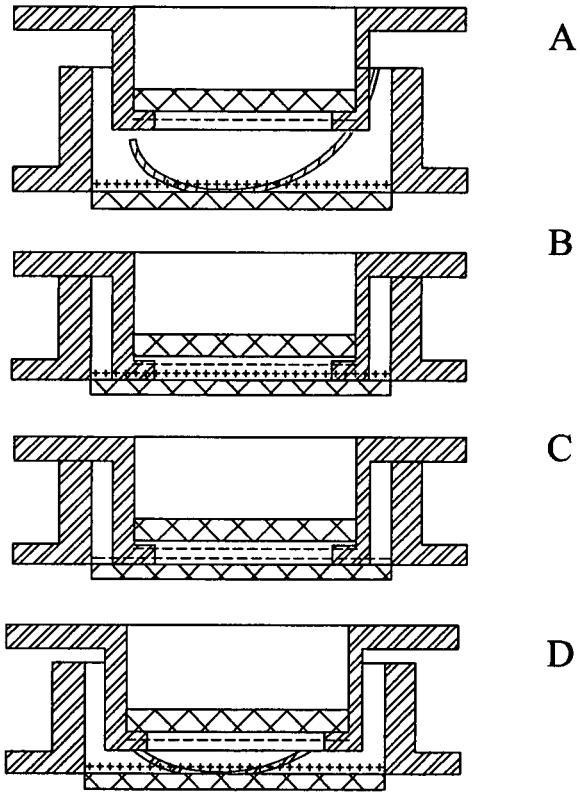
FIG. 8 is a series of diagrams illustrating the operation of the fastener shown in FIG. 7.

In the open state, the electromagnet is poled for attraction of the permanent magnet. As the door shuts, the two parts of the device mutually engage, as shown in FIG. 8A, the device would auto close under magnetic attraction, with relative rotation between the parts effected through engagement of the pins 706 with the right-handed thread formation. When the lock bottoms, as shown in FIG. 8B, the electromagnet is arranged to reverse polarity, as shown in FIG. 8C, forcing the plug up the left handed thread to a locking feature.

At this stage, as shown in FIG. 8D, the door is locked and the resistance to opening is provided for not by the magnets but by the structural strength of the location device (the pin or the thread).

On swiping of an authorised entry card, the electromagnet is poled the opposite way and the location device is pulled the reverse way down the opposite thread from whence the polarity is reversed again so that the plug is automatically ejected.

Reversing of the current supplied to the electromagnet on bottoming of the lock can be achieved with a wide variety of electronic or electromechanical devices well known to the skilled reader.

It will be understood that many of the features described here in relation to permanent magnets and electromagnets can be interchanged and used in different combinations. It would thus be possible to use the feature of magnetic repulsion maintaining a fastener in a closed position, with an arrangement of two permanent magnets. Many of the described permanent magnets can be substituted with an electromagnet in an appropriate application.

Examples of other applications where fasteners according to the present invention can be used with advantage are pyrotechnic line devices which can provide for automatic release and ejection, docking devices for electronic apparatus and automatic door safety locks which effect automatic unlocking of a vehicle door on detection of an impact or threatened impact.

The invention claimed is:

1. A fastener comprising two parts separable along a separation axis, at least one part comprising a magnet establishing magnetic force along the separation axis; and a mechanical coupling having complementary elements formed respectively on the two parts of the fastener, the mechanical coupling being configured such that movement together of the two parts under magnetic force causes automatic relative rotation of the parts about the axis, wherein at least one of the complementary elements of the mechanical coupling is of helical formation about the separation axis.

2. A fastener according to claim 1, wherein the helical angle of the screw formation is $\alpha$ and the coefficient of friction $\mu_f$ in the mechanical coupling is selected such that $\tan^{-1}(\mu_f) <= \alpha$.

3. A fastener according to claim 2, wherein each of the parts has a mounting element, as least one of the parts being arranged for rotation relative to its associated mounting part.

4. A fastener according to claim 1, wherein at least one of the complementary elements of the mechanical coupling is a helical formation about the separation axis.

5. A fastener according to claim 1, wherein each of the parts has a mounting element, as least one of the parts being arranged for rotation relative to its associated mounting part.

* * * * *